United States Patent [19]

Pöllmann

[11] 4,273,295

[45] Jun. 16, 1981

[54] AGITATOR MILL

[75] Inventor: Josef Pöllmann, Lorenzreuth, Fed. Rep. of Germany

[73] Assignee: Gebruder Netzsch, Maschinenfabrik GmbH & Co., Fed. Rep. of Germany

[21] Appl. No.: 26,853

[22] Filed: Apr. 4, 1979

[51] Int. Cl.[3] ..... B02C 23/10

[52] U.S. Cl. ..... 241/46.11; 241/172; 241/285 A

[58] Field of Search ..... 241/46.11, 46.17, 66, 241/67, 172, 173, 179, 285 A

[56] References Cited

U.S. PATENT DOCUMENTS 4,059,232 11/1977 Engels ..... 241/46.17

4,129,261 12/1978 Engels et al. ..... 241/172 X

FOREIGN PATENT DOCUMENTS 1325835 8/1973 United Kingdom .

*Primary Examiner*—Richard B. Lazarus

*Attorney, Agent, or Firm*—Karl W. Flocks

[57] ABSTRACT

An agitator mill for the continuous processing of flowable grinding stock with a bearing housing arranged on a stand, a drive shaft which turns in at least one bearing of the bearing housing with a detachable grinding chamber attached to the bearing housing which is equipped with a grinding stock intake and contains grinding stock as well as grinding bodies and also having a detachable agitator shaft coupled to the bearing housing and reaching into the grinding chamber where it carries at least one agitating element, a discharge chamber situated between the grinding chamber and at least one bearing and a separation system arranged between the grinding chamber and the discharge chamber which is equipped with a separator ring rotating about the agitator shaft and a stationary ring attached to the bearing housing. Between the two is a separation slit which will permit the processed grinding stock to flow through but will retain the grinding bodies.

9 Claims, 6 Drawing Figures

AGITATOR MILL

BACKGROUND OF THE INVENTION

The present invention refers to an agitator mill or agitator-grinder for the continuous processing of flowable grinding stock.

Agitator-grinders of this type are used for the continuous ultra-fine grinding and/or suspension or disintegrating of liquid, powdery or pulpy substances, as for example food stuffs, dyes, bacterial cultures, etc. Grinding bodies may be beads of glass or ceramics or other hard and wear-resistant materials. Their diameters depend on the degree of reduction desired for the grinding stock to be processed; generally, this width should be of an order of magnitude of from 3 to 0.1 mm (0.1181 to 0.00395 in.).

The smaller the grinding bodies, the smaller must be the width of the separator slit in the separator. Generally, this width should be of an order of magnitude of from $\frac{1}{2}$ to $\frac{3}{4}$ of the diameter of the grinding bodies. To maintain the very small width of the separating slit required for small grinding bodies within tight tolerances require that the separator ring revolving with the agitator shaft be placed with a high degree of accuracy coaxially with respect to the stationary separator ring and that the axial position of both separator rings with respect to each other be established accurately. This requires that the rotating separator ring be positioned as motion-free as possible in an axial direction.

Another problem inherent in agitator-grinders of the type described is that they cannot be used continuously for the same type of grinding stock generally but that they have to be adjusted more or less frequently for the processing of different grinding stocks. This may require that the grinding chamber and the agitator shaft are exchanged or that frequent changes be made in the separator system either because the separator rings are worn or the width of the separator slit has to be widened or reduced.

In the case of a well-known agitator-grinder of the type described in British Pat. No. 1,325,835, published Aug. 8, 1973, the agitator shaft extends axially through the drive shaft, which for this purpose has been formed tubally. It is braced against the end of the drive shaft which is situated in the discharge chamber by means of two spacers which are placed on the agitator shaft in the region of the separator system and the discharge chamber. The end of the agitator shaft away from the grinding chamber extends beyond the corresponding end of the drive shaft and is attached to it by means of a clamp nut. The rotating separator ring is clamped between the two truncated-con-shaped spacers and through these and the agitator shaft, centered only indirectly with respect to the drive shaft. A change of grinding chamber and agitator shaft necessitates that, after the clamp nut has been loosened, the grinding chamber together with the agitator shaft be moved away from the bearing housing in an axial direction for some distance which is greater than the total length of the drive shaft. The amount of space required for this purpose is considerable and it does not matter whether it is an upright agitator-grinder (with vertical axis) or a long agitator-grinder (with horizontal axis). The difficulties of pulling the grinding chamber and the agitator shaft on the one hand and the bearing housing on the other become especially great when the bearing housing for reasons of design simplicity is attached to a stand or formed in one place and then attached solidly to a foundation.

This well-known agitator as described causes additional difficulties through the fact that the agitator shaft can be removed only together with the rotating separator ring. This requires that it be adjusted with extreme care along the axial direction during reassembling so that the rotating separator ring will again be in an exact axial position with respect to the stationary separator ring.

This is of special importance for separator systems as far as the generally plane, radial separator slit as well as the separator systems with truncated cone-shaped separator slits are concerned. In the case of the letter separator systems as well as those with a cylindrical separator slit any rotational inaccuracy of the rotational shaft caused, for example, by bending stress, and found in the region carrying the rotating separator ring may lead to the undesirable consequence that the width of the circular separator slit may change cyclically and that the rotating separator ring would possibly come into contact with the stationary separator ring. This holds true for noticeable bending in the agitator shaft and a large diameter of the rotating separator ring even if we are concerned with a separator system having a radial separating slit.

SUMMARY OF THE INVENTION

The invention, therefore, is based on the problem that an agitator-grinder of the type described previously has to be modified in such a way that the grinding chamber and agitator shaft can be removed easily and quickly from the bearing housing and, if required, can be replaced by another grinding chamber without interfering with the exact setting of the separator slit or requiring a difficult readjustment.

On the basis of this invention the problem is solved by fastening the rotating separator ring to the drive shaft independent of the agitator shaft and by making the agitator shaft detachable from the drive shaft in the region between the grinding chamber and at least one of the bearings arranged in the bearing housing.

The attachment of the rotating separator ring to the drive shaft independent of the agitator shaft makes it possible that the agitator shaft can be removed without change in the position of the rotating separator ring with respect to the stationary separator ring. The arrangement of the place of separation between agitator shaft and drive shaft according to this invention further permits that grinding chamber and agitator shaft need be moved only a short distance from the bearing housing in an axial direction before they can be moved in a radial direction (for which sufficient space is available) sufficiently far to permit, for example, cleaning or the replacement of a grinding chamber and/or another agitator shaft.

BRIEF DESCRIPTION OF THE DRAWINGS

Examples of embodiments of the invention are explained in greater detail in connection with the following drawings in which.

DESCRIPTION OF THE PREFERRED EMBODIMENTS

Figure 1:
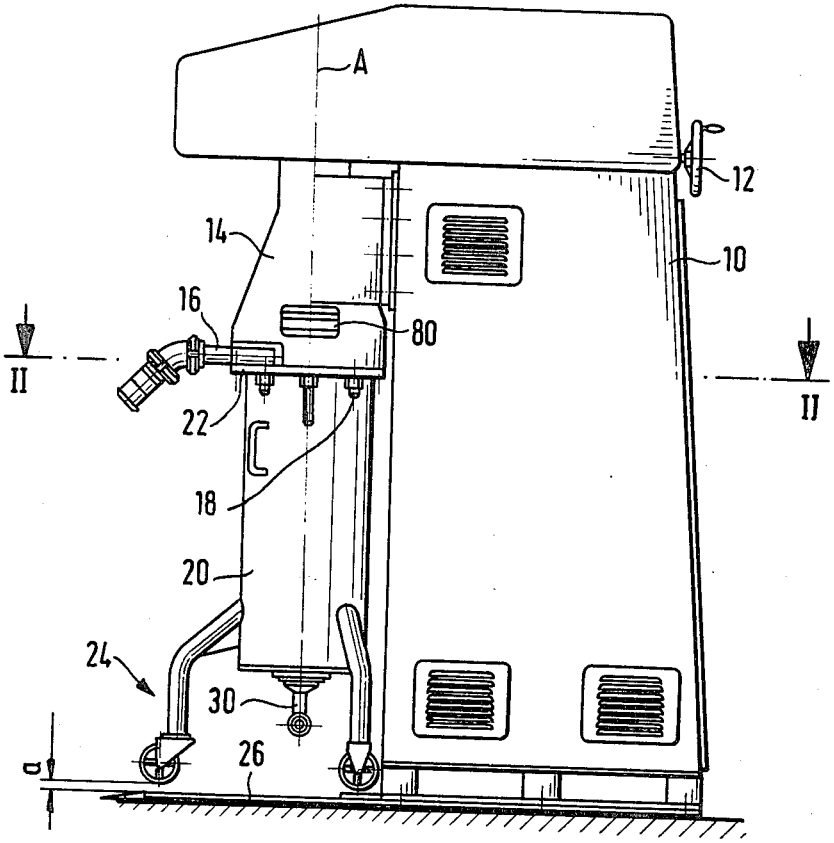
FIG. 1 illustrates a side view of an upright agitator-grinder of the present invention.
Figure 2:
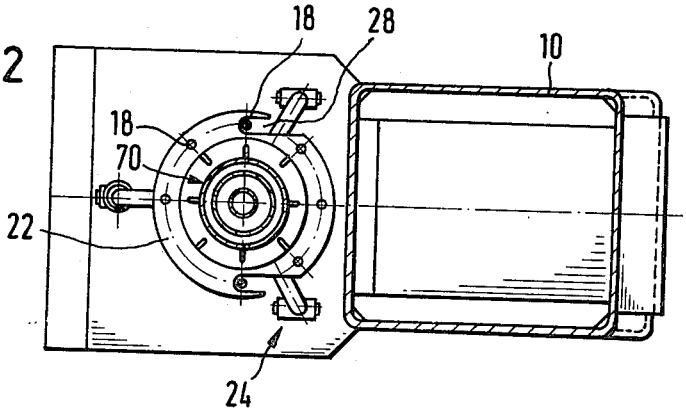
FIG. 2 shows a horizontal cross section along line II—II in FIG. 1.

The agitator-grinder shown in FIGS. 1-4 has a box-like stand 10 which is equipped with a drive system (not shown), for example, a motor with a hand wheel 12 and a stepless adjustable reduction ratio. Screwed to the front of the stand 10 is a bearing housing 14 which, with respect to a vertical axis A, is essentially arranged rotation-symetrically and has a grinding stock discharge chamber 16. At the lower side of the bearing housing 14 are attached axial-parallel thread bolts 18 which fasten a flange 22 situated at the upper edge of a grinding chamber 20 closely to the bearing housing 14. The grinding chamber 20 is equipped with a drive system 24 which in the operating position shown floats above the base or ground plate 26 at a distance a. The loosening of the nuts attached to bolts 18 permits the separation of the grinding chamber 20 from the bearing housing 14; two of the bolts 18 are long enough to lower the grinding chamber 20 after removal of the corresponding nuts gradually by a distance a until the flange 22 rests below the lower ends of the generally shorter bolts and the drive system 24 stands on the ground plate 26.

The two long bolts 18 each extend through an open slit 28 in flange 22 facing the stand so that the grinding chamber 20 may be pushed away without difficulty after it has been lowered and after a tube and hose system not shown in the drawings has been uncoupled from the grinding stock inlet 30 provided at the bottom of the grinding chamber 20.

In the bearing housing 14 a tubular drive shaft 32 is situated in a pair of upper ball bearings 34 so that it cannot be moved axially; in addition, it is situated some distance below in a roller bearing 36; these three bearings and the drive shaft itself have a very exact rate of revolution. The drive shaft 32 is connected with or at its upper end with the driving unit already mentioned so that it can be made to rotate with a desired, adjustable speed. The lower portion of the drive shaft 32 extends through a shaft packing with an upper gasket housing 40 and a lower gasket housing 42 which are both formed like flanges and screwed to the bearing housing 14. Inside the lower gasket housing 42 compression springs 44 are braced parallel to the axis. By means of a compression ring 46 they push a non-rotating slide ring 48 downward against a rotating slide ring 50. Both of these slide rings consist of carbide, for example. The rotating slide ring 50 is clamped between a bushing 52 pushed from below onto the drive shaft 32 and a nut 54 screwed onto the lower end of the drive shaft. A rotating separator ring 56 is screwed to the lower end of the tubular drive shaft 32 by screws 57 and centered at the inside. At its radially outer rim the separator ring 56 has attached thereto a ring-shaped carbide insert 58. Radially outside the rotating separator ring 56 is a stationary separator ring 60 which can be screwed to the bottom side of the bearing housing 14. The stationary carbide ring 60 carries at its radially inner rim a ring-like carbine insert 62 which, together with the rotating ring-like carbide insert 58 limits an essentially cylindrical, towards the end expanding, separation slit 64. Both the carbide inserts 58 and 62 will wear out and can be replaced. Together with their separator rings 56 and 60 to which they are attached the inserts 58 and 62 carry a separator unit 66 between grinding chamber 20 and a discharge chamber 68 arranged around the lower part of the drive shaft 32 with the bearing housing 14, to which is attached the grinding stock discharge 16.

Figure 3:
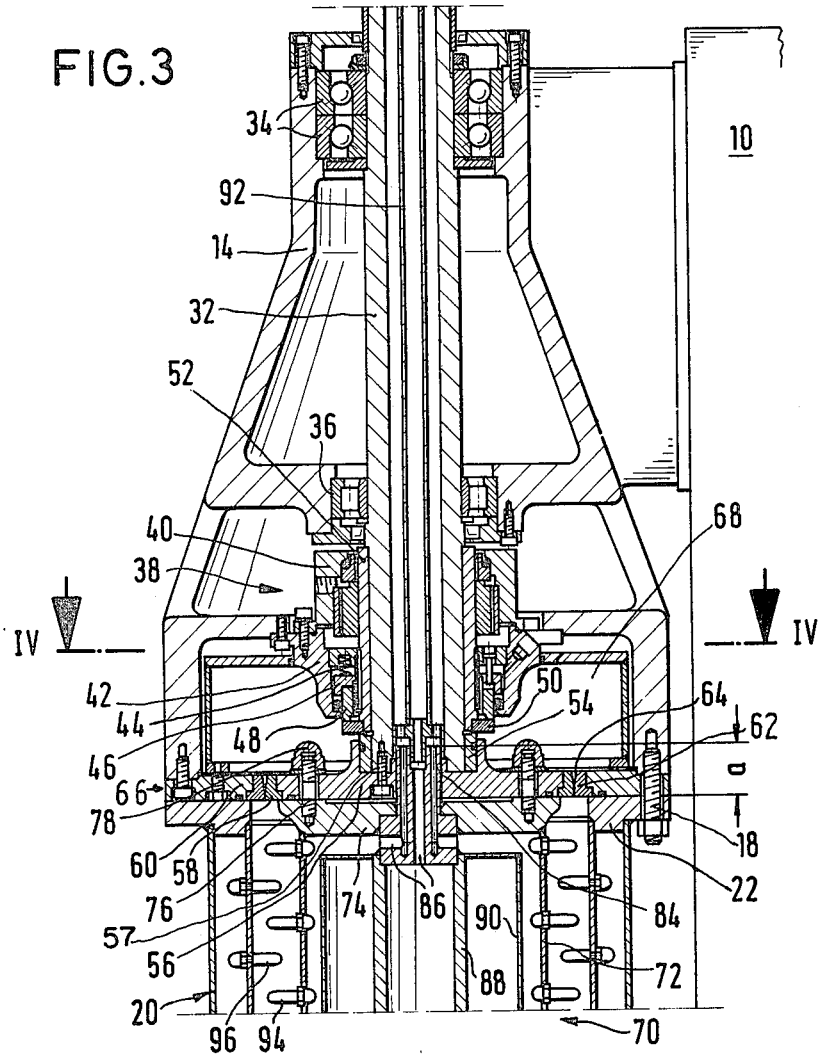
FIG. 3 shows a vertical axial partial cross section along line III—III in FIG. 1 on a considerably enlarged scale.

An agitator shaft 70 is positioned coaxially with the drive shaft 32 and the separator system 66 in the grinding chamber 20. It has a cylindrical outer jacket 72 and an upper front plate 74 and is closed off at the other end in a corresponding way. This other end portion is not shown. Situated in the front plate 74 are bolts 76 which, according to FIG. 3 are shown as thread bolts. They extend upward through holes in the rotating separator ring 56 and inside the discharge chamber 68 they are capped by nuts 78 which are fastened in such a way that front plate 74 is clamped solidly and tightly to the rotating separator ring 56. The nuts 78 can be reached through openings 80 in the lower portion of the bearing housing 14 once the covers 82 are removed which covers close the openings during operation. One of these covers 82 carries the grinding stock discharge chamber 16.

Positioned in a concentric, stepped drill hole in the front plate 74 is a connecting piece 84 which is welded to the front plate 74 and is inserted with a tight sliding fit into a concentric drill hole of the rotating separator ring 56. The connecting piece carries coolant channels 86 of which one terminates at a tubular core 88 of the agitator shaft 70 which is welded to the lower portion of the connecting piece. Other coolant channels 86 terminate between the cylindrical jacket 72 and an equally cylindrical partition 90 of the agitator shaft 70. Enclosed in the upper portion of the connecting piece 84 is a coolant pipe 92 which is arranged coaxially with the drive shaft 32 and connected to a coolant pump (not shown) in the stand 10. This coolant pump can pump a coolant, for example, water, through a coolant pipe 92, the axial coolant channel 86 in the connecting piece 84 and the tubular core 88 to the lower end (not shown) of the agitator shaft 70. From there it flows outside the partition 90 immediately within the cylindrical jacket 72 of the agitator shaft 70, upward and back through the outer coolant channels 86 and inside the drive shaft 32, but outside the coolant pipe 92 into a coolant container (not shown) also arranged in the stand 10.

According to FIG. 3 the agitator shaft 70 carries stick-like agitating elements 94 which are attached to the jacket 72 and extend from there toward and close to the inner wall of the grinding chamber 20. Staggered with these agitating elements 94 in an axial direction are counter stick agitating elements 96 attached to the grinding chamber 20 and extending radially inward close to the jacket 72. Once the grinding chamber 20 has been lowered a distance a or more in the manner described by loosening the nuts on the thread bolts 18, the agitator shaft 70 can be detached from the rotating separator ring 56 by unscrewing the nuts 78. As the agitator shaft 70 is lowered, its connecting piece 84 is detached from the lower portion of the coolant pipe 92 and consequently slides from the concentric drill hole of the rotating separator ring 56. As soon as the agitator ring 70 also has been lowered in a similar way by at least the distance a, the grinding chamber 20 and the agitator shaft can be pushed off.

Figure 4:
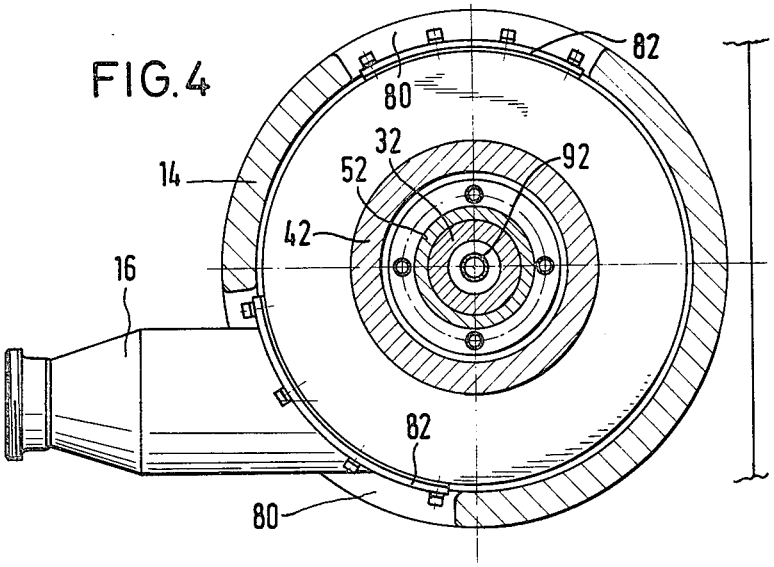
FIG. 4 shows a horizontal cross section along line IV—IV in FIG. 3.
Figure 5:
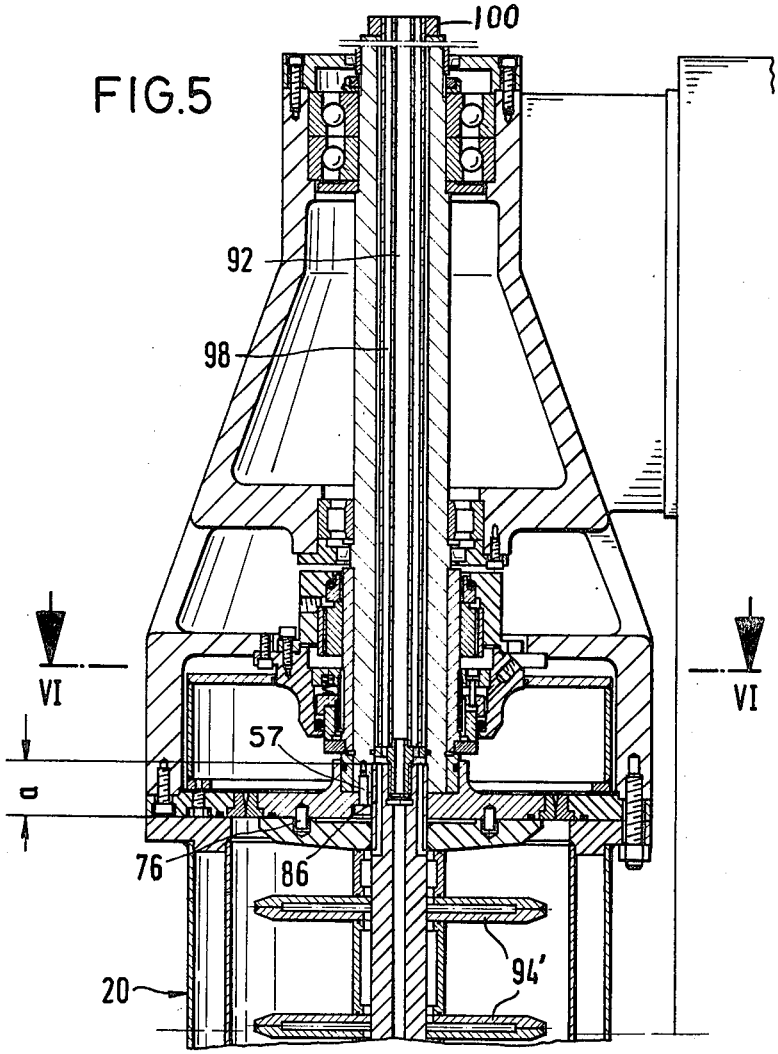
FIG. 5 shows a cross section through a modified embodiment of an agitator-grinder corresponding to the view shown in FIG. 3.
Figure 6:
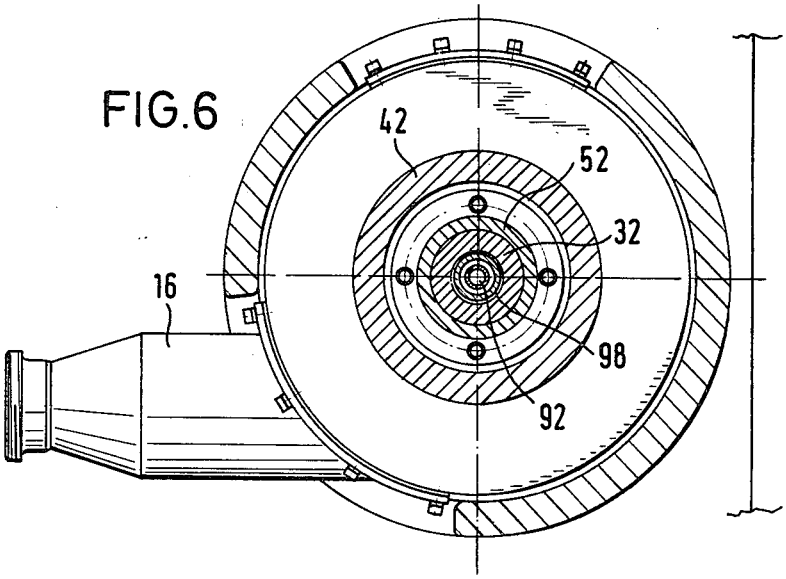
FIG. 6 shows a horizontal cross section along line VI—VI in FIG. 5.

The agitator-grinder model shown in FIGS. 5 and 6 differs from that shown in FIGS. 3 and 4 only in some details. Those building elements which have not been changed or are equivalent carry the same numbers in FIGS. 5 and 6 as in FIGS. 3 and 4. According to FIG. 5, the bolts 76 are connected to the rotating separator ring 56 and from there extend downward into smooth holes of the front plate 74. In this case the bolts 76 have only the task of transmitting the turning moment of the drive shaft 32 from the rotating separator ring 56 to the front plate 74 and thus to the agitator shaft 70, the separator ring 56 being screwed to the drive shaft 32 as is the case with the embodiment shown in FIGS. 3 and 4. The axial force required to keep the front plate 74 attached to the lower side of the rotating separator ring 56 is produced by a tubular tie rod 98 which is screwed from above into the connecting piece 84 of the agitator shaft 70. It extends coaxially upward within the drive shaft 32 and carries at its upper end a clamp nut 100 which is braced at the upper end of the drive shaft 32. The coolant pipe 92 is arranged here coaxially with the tubular tie rod 98.

In addition, in the embodiment shown in FIGS. 5 and 6, the agitator shaft is more slender and equipped with hollow, disk-like agitating elements 94'. If in the embodiment according to FIGS. 5 and 6 after the lowering of the grinding chamber 20 by at least a distance a the agitator shaft 70 is to be separated from the drive shaft 32, it is necessary only to loosen the clamp nut 100 and to screw the tie rod 98 together with the coolant pipe 92 from the upper end of the connecting piece 84. As described for FIG. 3, the connecting piece 84 can then be pulled downward out of the rotating separator ring 56.

In both embodiments described, the ring-shaped carbide inserts 58 and 62 can be removed easily once the grinding chamber 20 and the agitator shaft 70 have been lowered in the manner described. If in addition the rotating separator ring 56 and the nuts 54 of the drive shaft 32 and the stationary separator ring 60 have been unscrewed from the bearing housing 14, the shaft packing 38 also can be removed easily by unscrewing the lower gasket housing 42 together with the attached upper gasket housing 40 of the bearing housing 14.

It will be obvious to those skilled in the art that various changes may be made without departing from the scope of the invention and the invention is not to be considered limited to what is shown in the drawings and described in the specification.

What is claimed is:

1. An agitator mill for the continuous processing of grinding stock comprising a stand, a bearing housing arranged on said stand and having at least one bearing, a drive shaft which turns in said at least one bearing of said bearing housing, a detachable grinding chamber attached to said bearing housing having a grinding stock intake and containing grinding stock as well as grinding bodies, a detachable agitator shaft coupled to said bearing housing and reaching into said grinding chamber where it includes at least one agitating element carried on said shaft, a discharge chamber situated between said grinding chamber and said at least one bearing, and a separation system arranged between said grinding chamber and said discharge chamber including a separator ring rotating together with said agitator shaft, a stationary ring attached to said bearing housing, a separation slit between the two said rings to permit the processed grinding stock to flow through but to retain the grinding bodies, characterized by the fact that said rotating separator ring (56) is attached to said drive shaft (32) independently of said agitator shaft (70) which is also attached to said drive shaft (32) and that said agitator shaft (70) in the region between said grinding chamber (20) and said at least one bearing (36) situated in said bearing housing (14) is detachable from said drive shaft (32) while said separator ring (56) remains attached to said drive shaft (32).

2. The agitator mill according to claim 1 wherein said drive shaft is supported in said bearing housing by more than one bearing, characterized by the fact that said agitator shaft (70) can be detached from said drive shaft (32) in the region between said bearing (36) situated closest to said separator system (66) and said grinding chamber (20).

3. The agitator mill according to claim 1 wherein said discharge chamber is separated from said at least one bearing situated in said bearing housing by a shaft packing sealing said drive shaft from said bearing housing characterized by the fact that said agitator shaft (70) is detachable from said drive shaft (32) between said shaft packing (38) and said grinding chamber (20).

4. The agitator mill according to claim 1 further characterized by the fact that said agitator shaft (70) is centered at said rotating separator ring (56) and connected through it with said drive shaft (32) for the purpose of joint rotation.

5. The agitator mill according to claim 4 further characterized by the fact that said agitator shaft (70) has a front plate (74) which is shaped at least approximately matching with said rotating separator ring (56) and connected with it by paraxial bolts (76).

6. The agitator mill according to claim 5 further characterized by the fact that said paraxial bolts (76) which are attached to said front plate (74) are thread bolts which extend through holes in said rotating separator ring (56) and are fastened with nuts (78) which are accessible from the outside of the mill through said discharge chamber (68).

7. The agitator mill according to claim 5 wherein said drive shaft is tubular along its total length and further characterized by a tie rod (98) which is braced against that end of said drive shaft (32) which is facing away from said grinding chamber (20), said agitator shaft (70) being screwed detachably to said tie rod.

8. The agitator mill according to claim 7 further characterized by the fact that said tie rod (98) is tubular and made a part of a coolant cycle for the cooling of said agitator shaft (70).

9. The agitator mill according to claim 1, further characterized by said drive shaft being tubular along its total length, a coolant pipe (92) situated coaxially in said drive shaft (32), said agitator shaft (70) connected detachably to said coolant pipe (92).

* * * * *